US006068117A

United States Patent [19]

Koehn

[11] Patent Number: 6,068,117

[45] Date of Patent: May 30, 2000

[54] BOOK INSERT CD CARRIER DEVICE

[75] Inventor: Annalee Koehn, Chicago, Ill.

[73] Assignee: R. R. Donnelley & Sons, Chicago, Ill.

[21] Appl. No.: 09/353,681

[22] Filed: Jul. 14, 1999

[51] Int. Cl.[7] ..... B65D 85/57

[52] U.S. Cl. ..... 206/232; 206/312

[58] Field of Search ..... 206/232, 307, 206/308.1, 311, 312, 454, 455

[56] References Cited

U.S. PATENT DOCUMENTS

| | | | |
|---|---|---|---|
| 4,620,630 | 11/1986 | Moss | 206/45.24 |
| 4,765,466 | 8/1988 | Ivey | 206/232 |
| 4,793,477 | 12/1988 | Manning et al. | 206/232 |
| 4,850,731 | 7/1989 | Youngs | 402/79 |
| 5,088,599 | 2/1992 | Mahler | 206/313 |
| 5,224,599 | 7/1993 | Uchida | 206/444 |
| 5,290,118 | 3/1994 | Ozeki | 402/79 |
| 5,570,782 | 11/1996 | Kikuchi et al. | 206/312 |
| 5,590,912 | 1/1997 | Stevens | 283/56 |
| 5,600,628 | 2/1997 | Spector | 206/312 |
| 5,669,491 | 9/1997 | Pettey | 206/232 |
| 5,690,220 | 11/1997 | Swan | 206/308.1 |
| 5,697,496 | 12/1997 | Bauer | 206/308.1 |
| 5,713,605 | 2/1998 | Pace et al. | 281/38 |
| 5,782,349 | 7/1998 | Combs | 206/308.1 |

*Primary Examiner*—Jacob K. Ackun
*Attorney, Agent, or Firm*—Marshall, O'Toole, Gerstein, Murray & Borun

[57] ABSTRACT

A book insert CD carrier device is provided that allows for the unitary packaging and thus marketing of books and compact disks or other similar media. The carrier device is constructed of a single sheet of paper board that is easily assembled into a carrier that holds compact disks and that is easily secured to the inner or outer surface of the front or back cover of a book. Due to the configuration of the paper board sheet, which includes a plurality of panels that are divided by a plurality of hinge lines, the assembly process involves folding specified panels and securing the panels as necessary to create a pocket within which the compact disks are stored. The carrier further includes a cover that features a tear strip seal for enclosing the CDs within the pocket. A set of panels cooperate to form a sturdy base by which the carrier is secured to the cover of the book. The carrier is rotatable about a pivot hinge that thereby allows access to the contents of the carrier while also permitting the book cover to close or nearly fully close.

22 Claims, 4 Drawing Sheets

BOOK INSERT CD CARRIER DEVICE

FIELD OF THE INVENTION

The present invention generally relates to a book insert and, more particularly, to a book insert having one or more pockets for carrying compact disks.

BACKGROUND OF THE INVENTION

In recent years, it has become desirable to market books and an additional media, such as, for example, audio cassette tapes, computer disks and compact discs, as a single unit. By marrying the technology of sound recordings or computer files with the printed text of books, the entertainment and/or informational value of the books is enhanced thereby increasing the marketability of such books. More specifically, the recent popularity of compact discs, commonly referred to as CDs, combined with the small size of CDs has made the sale of books together with CDs particularly attractive. To enable the successful marketing of a combination book and CD product, a carrier device for packaging the books and CDs as a single unit is required. Presently, a number of devices are available for packaging compact disks or similarly shaped media with books or the like.

By way of example, Uchida U.S. Pat. No. 5,224,599 discloses a container for holding a floppy disc that has a double-sided adhesive strip on a back panel of the container for securing the container to the inside of a binder. The container additionally comprises a flexible plastic square-shaped film that is attached at three edges of the film to the back panel. The fourth edge of the film is not attached to allow for insertion of a floppy disk.

As for other examples, Pace et al. U.S. Pat. No. 5,713,605 discloses a folder for binding and mailing CDs. In particular, the folder is made from a single web of card stock that is folded into two equal panels along a central fold line. One of the panels serves as a rear panel for the folder while the other panel serves as a front panel which is positioned atop the rear panel. A protectively wrapped CD is applied to the rear panel of the folder with an adhesive. In addition, the folder includes a line of weakening along one edge to define a combined binding and tear strip. The teal strip may be edge bound in a magazine and the line of weakening spaced from the edge to facilitate the separation of the folder from the magazine along the tear strip. As yet another example, Stevens U.S. Pat. No. 5,590,912 discloses a personalized envelope assembly for a disc that can be bound into the interior of a printed publication.

In addition to patents directed to the unitary packaging of CD-like media with books, several patents are directed to techniques for packaging a CD individually or in combination with other CDs. For example, Bauer U.S. Pat. No. 5,697,496 discloses a package for a compact disk or computer diskette that includes a corrugated board inset attached to a panel of a die-cut sleeve. The sleeve folds to create a cavity within which the corrugated board is positioned. The corrugated board includes a CD shaped recess for holding the CD. Moreover, the die cut sleeve includes a perforated tear strip to provide for easy opening of the package.

For a further example, Manning U.S. Pat. No. 4,793,477 discloses a storage container having the overall appearance of a conventional book but which actually includes an interior cavity having pockets for holding compact disks or audio cassettes. Lastly, Pettey U.S. Pat. No. 5,669,491 is directed to a compact disc folder having the form of a booklet with a front and back cover, and a pocket for holding CDs is attached to the interior of the front cover.

It is desirable to provide a carrier device which enables the packaging of a CD(s) with a book as a single unit that is light-weight, inexpensive and that is detachably secured to the book without adding bulk and without increasing the dimensional size of the book. Moreover, it is desirable that the packaging unit be easily manufactured and be usable as a storage unit for the CD while the CD is not in use.

In one or more respects, the earlier attempts discussed above have failed to meet these criteria in their entirety. As a result, the present invention is directed to overcoming this failure and achieving one or more of the resulting objects.

SUMMARY OF THE INVENTION

Accordingly, the present invention provides a carrier device that is suitable for carrying compact discs or similarly shaped objects and that is readily attachable to the front or rear cover of a book.

More particularly, the present invention is directed to a carrier comprising a single sheet of paperboard having a plurality of panels that are divided by a plurality of hinge lines. The panels are folded about the hinge lines to form one or more pockets for carrying a disc-shaped object and to form a base for securing the carrier to a book. The folded panels also form a pivot hinge for rotating the carrier relative to the base and a cover for the pocket.

Among the panels that fold to form the pocket are a main panel and a pocket panel that are disposed adjacent to one another and that are divided by a hinge line. The pocket panel is folded about the hinge line toward the main panel and is secured to the main panel by, for example, a strip of adhesive, to form a recess between the main panel and the pocket panel. A strip of adhesive may also be positioned such that the pocket formed by securing the pocket panel to the main panel is divided into a set of compartments, each of which is preferably sized to hold a compact disc. To allow for viewing the contents of the pocket, it is preferable that the pocket includes a window covered by a translucent film.

The main panel may also include a first tab and a second tab, each of which is disposed on opposing first and second sides of the main panel, by which the pocket panel is secured to the main panel.

The base of the carrier is formed by a pivot panel and an attachment panel. The pivot panel is disposed adjacent to the main panel and is divided from the main panel by a first hinge line, whereas the attachment panel is disposed adjacent to the pivot panel and is divided from the pivot panel by a second hinge line. To form the base, the attachment panel is folded about the second hinge line until the attachment panel abuts against the pivot panel. Either the attachment panel or the pivot panel of the carrier base is secured to the interior or exterior surface of the front or rear cover of the book by a strip of adhesive which preferably comprises a peal and seal adhesive strip.

To allow the carrier to rotate relative to the book cover, the carrier includes a pivot hinge which is formed by folding the attachment panel about the second hinge line until the attachment panel abuts against the pivot panel. Folding the attachment panel in this manner causes the first hinge line to align with a third hinge line that divides the attachment panel from the pocket cover. The aligned first and third hinge lines form the pivot hinge. For added flexibility, the third hinge line may be perforated.

The cover for the pocket is adapted to enclose an opening in the pocket that is disposed between a first side of the pocket and a second side of the pocket. More particularly, the cover includes a tear strip, a set of first and second tear strip panels that are disposed on opposing sides of the tear strip, and a set of perforated seams. The first and second tear strip panels are divided from the tear strip by the set of seams and the first tear strip panel is secured to the first side of the pocket and the second tear strip panel is secured to the second side of the pocket.

In an alternative embodiment, the carrier comprises a single sheet of paperboard having an exterior surface and an interior surface and includes a main panel and a pocket panel that is disposed adjacent to the main panel and that is divided from the main panel by a first hinge line. The pocket panel is folded about the first hinge line and is secured to the interior surface of the main panel to form a pocket. A pivot panel is disposed adjacent to the main panel and is divided from the main panel by a second hinge line and an attachment panel is disposed adjacent to the pivot panel and is divided from the pivot panel by a third hinge line. The attachment panel is folded about the third hinge line until it abuts against the pivot panel to form a base which is adapted to be secured to the book. The carrier further includes a cover for the pocket which is disposed adjacent to the attachment panel and is divided from the attachment panel by a fourth hinge line that is disposed such that when the base is formed by folding the attachment panel until it abuts against the pivot panel, the second hinge line aligns with the fourth hinge line thereby to form a pivot hinge for rotating the carrier relative to the base.

In yet another embodiment, a carrier comprising a single sheet of paperboard having an exterior surface and an interior surface is provided. The carrier includes a main panel, a pocket panel, a pivot panel, an attachment panel and a pocket cover. The pocket panel is disposed adjacent to the main panel and is divided from the main panel by a first hinge line. The pocket panel is folded about the first hinge line and secured to the interior surface of the main panel to form a pocket. The pivot panel is disposed adjacent to the main panel and is divided from the main panel by a second hinge line. The attachment panel is disposed adjacent to the pivot panel and is divided from the pivot panel by a third hinge line. To form a base, the attachment panel is folded about the third hinge line until it abuts against the pivot panel and the exterior surface of the base is adapted to be secured to the book.

The pocket cover is disposed adjacent to the attachment panel and is divided from the attachment panel by a fourth hinge line that is disposed such that when the base is formed by folding the attachment panel until it abuts against the pivot panel, the second hinge line aligns with the fourth hinge line thereby to form a pivot hinge for rotating the carrier relative to the base.

The cover includes a set of two tear strip panels, each of which are disposed on opposing sides of the tear strip and are divided from the tear strip by a set of seams. The seams are perforated such that the tear strip may be removed from the sheet by pulling the tear strip thereby to cause the set of seams to separate. A first of the tear strip panels is secured to the interior surface of the main panel and a second of the tear strip panels is secured to the exterior surface of the pocket panel.

Strips of adhesive, such as, for example, peal and seal adhesive strips, are used to secure the various panels as specified. In addition, the pocket may include a set of two compartments each of which is preferably large enough to hold a compact disc.

Other objects, advantages and features of the present invention will become apparent from a consideration of the following specification taken in conjunction with the accompanying drawings.

DETAILED DESCRIPTION OF THE PREFERRED EMBODIMENT

Figure 1:
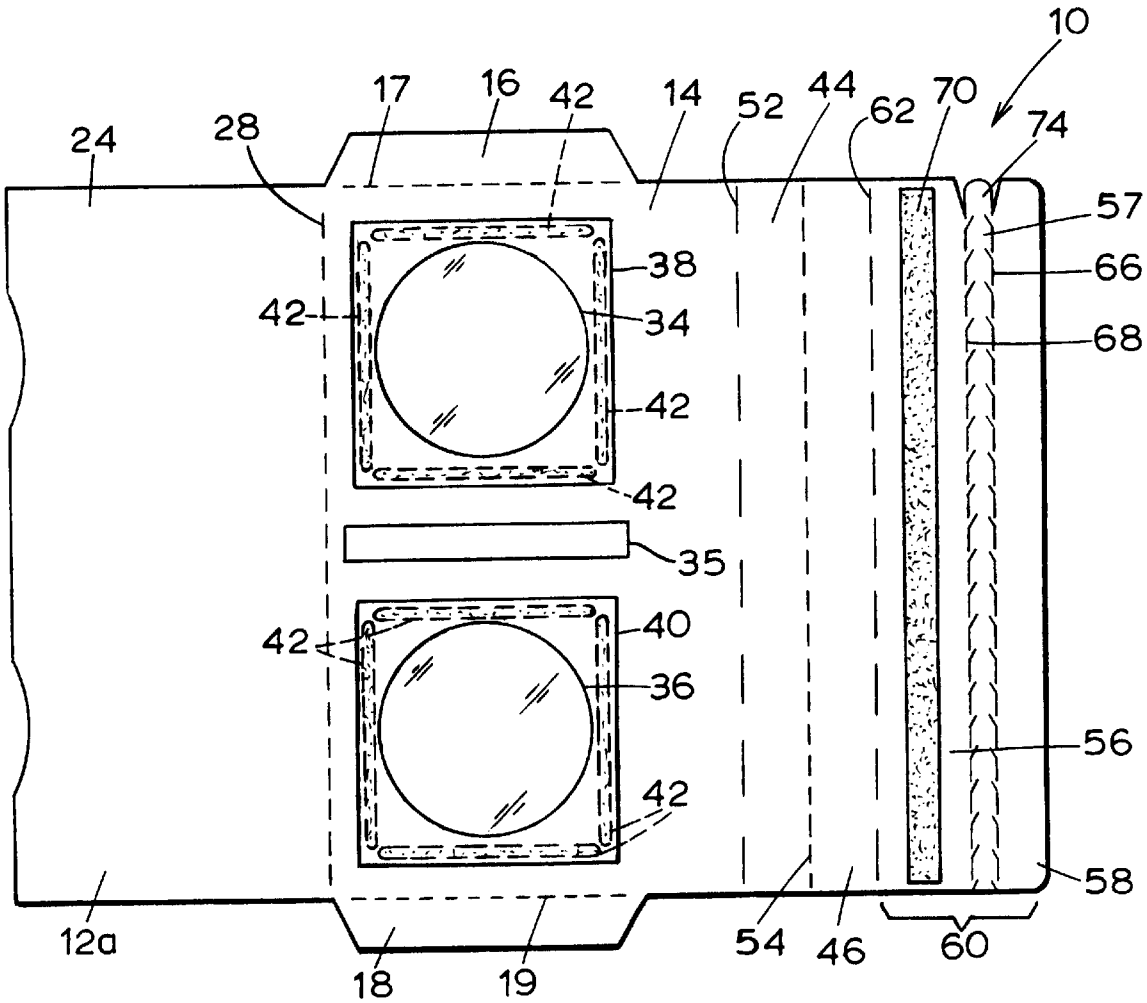
FIG. 1 is a plan view of an unassembled book insert CD carrier device shown with the non-glossy side exposed in accordance with the present invention.
Figure 2:
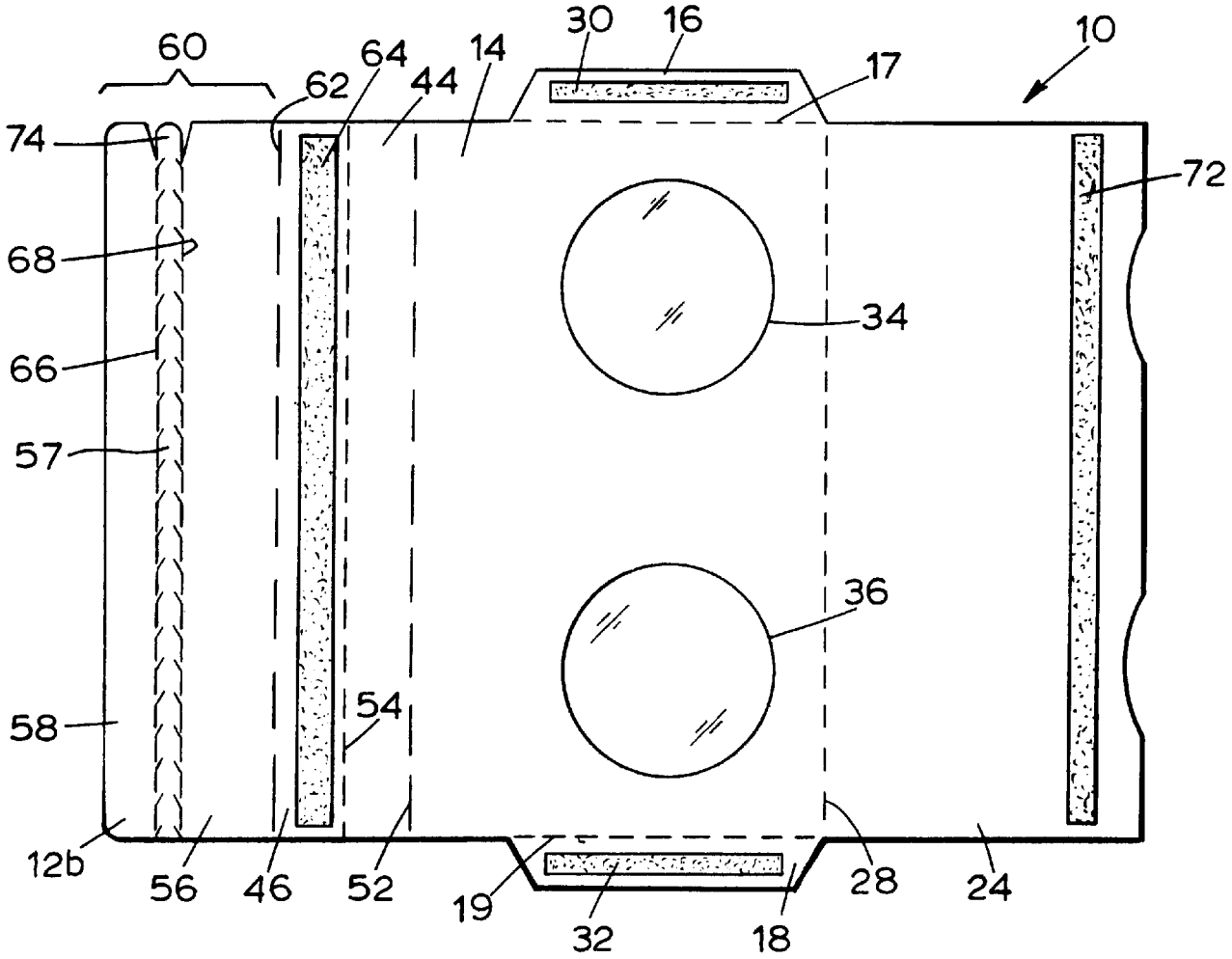
FIG. 2 is a plan view of the unassembled book insert CD carrier device shown with the glossy side exposed in accordance with the present invention.

In the illustrations given, and with reference first to FIGS. 1 and 2, the reference numeral 10 designates generally a carrier device made of a single sheet of paper board having two opposing surfaces one of which is non-glossy 12*a* (see FIG. 1) and the other which is glossy 12*b* (see FIG. 2). The paper board, which is preferably a stock of 12 pt SBS, is partitioned into a plurality of panels that are divided from one another by a plurality of hinge lines. As will be described, and with reference to FIG. 3, the panels are folded about the hinge lines and secured as necessary to form the carrier device 10 which is subsequently attached to the rear cover 11 of a book 13, Of course, it will be understood that the carrier device 10 may also be attached to the front cover of a book 13 and may be attached to either the interior or exterior surface of the rear or front cover. After the carrier device 10 has been assembled, the glossy surface 12*b* is generally exposed thereby to form the exterior surface of the carrier device 10 and thus may include graphics, symbols, or any other desired artistic representations. In contrast, the non-glossy surface 12*a* is not exposed as it forms the interior surface of the carrier device 10.

Figure 3:
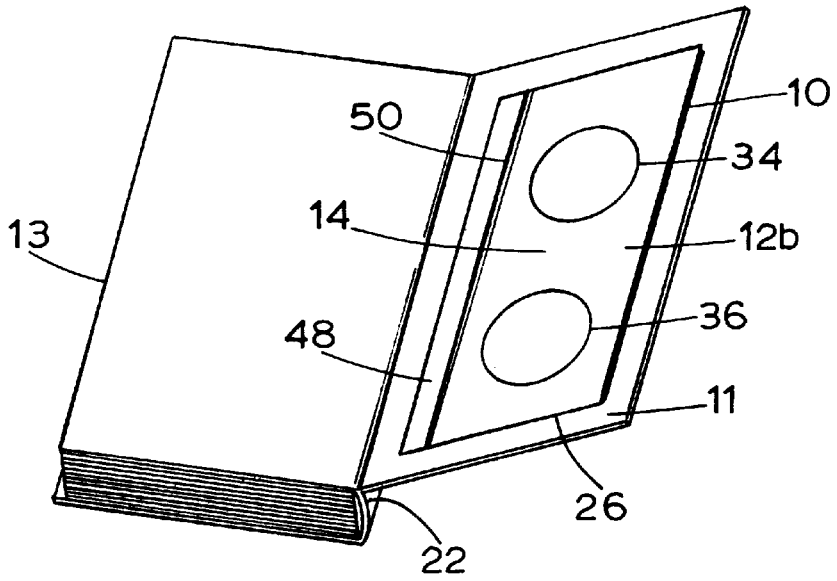
FIG. 3 is a view of an assembled book insert CD carrier device attached to the interior rear cover of a book.
Figure 4:
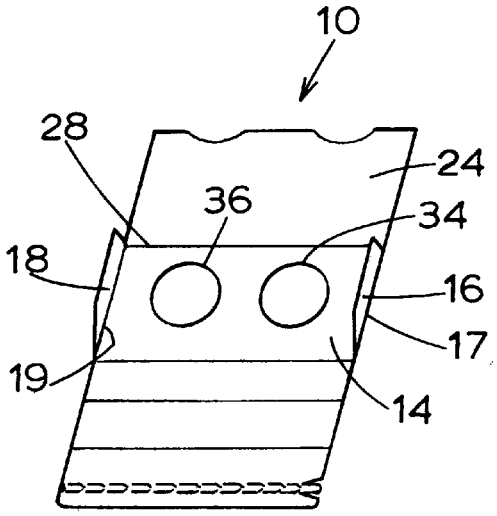
FIG. 4 is a view of the book insert CD carrier device that shows the manner in which a set of tabs are folded to form a pocket in which the CDs are held.

Referring still to FIGS. 1, 2 and 3, among the plurality of panels, is a main panel 14 having a set of tabs 16 and 18 that are divided from the main panel 14 by a set of hinge lines 17 and 19, respectively. The main panel 14 is preferably the largest of the panels and the carrier device 10 is preferably secured to the interior of the book cover 11 such that the length of the main panel 14 is disposed in a parallel or nearly parallel position relative to the book spine or backbone 22.

The main panel 14 is adjacent to a pocket panel 24 and cooperates with the pocket panel 24 to form a pocket 26 (see also, FIG. 7) for holding one or more disc-shaped objects, such as, for example, compact discs. Referring now to FIG.

Figure 5:
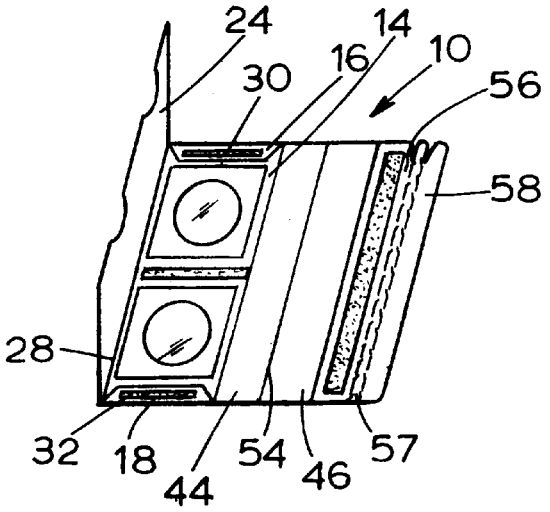
FIG. 5 is a view of the book insert CD carrier device that shows the manner in which a pocket panel folds toward a main panel and contacts the set of folded tabs to form the CD pocket.

4, the pocket 26 is formed by folding the tabs 16 and 18 about the hinge lines 17 and 19, respectively, and toward the non-glossy surface of the main panel 14 until the non-glossy surfaces of the tabs 16 and 18 abut against the non-glossy surface of the main panel 14. Referring also to FIG. 5, the pocket panel 24 is then folded about the hinge line 28 and toward the non-glossy side of the main panel 14 until the pocket panel 24 is brought into contact with a set of glue strips 30 and 32 that are disposed on the glossy surface of tabs 16 and 18, respectively, thereby causing the pocket panel 24 to adhere to the tabs 16 and 18 to form the recess or pocket 26 between the main panel 14 and the pocket panel 24.

Referring again to FIGS. 1 and 2, the main panel 14 further includes two circularly shaped cut-out portions 34 and 36 that form windows for displaying the CDs. Thus, it is preferable that the main panel 14 be at least as long as needed to house two standard-sized compact discs, i.e., about 12 centimeters or more in diameter. To provide for two separate CD compartments within the pocket 26, the pocket panel 24 is further attached to the main panel 14 by a strip of glue 35 disposed in the center of the main panel 14. To protect the CDs against damage while still allowing for display, two square shaped cellophane films 38 and 40 are attached to the non-glossy side of the main panel 14 over the windows 34 and 36 using strips of glue 42.

Figure 6:
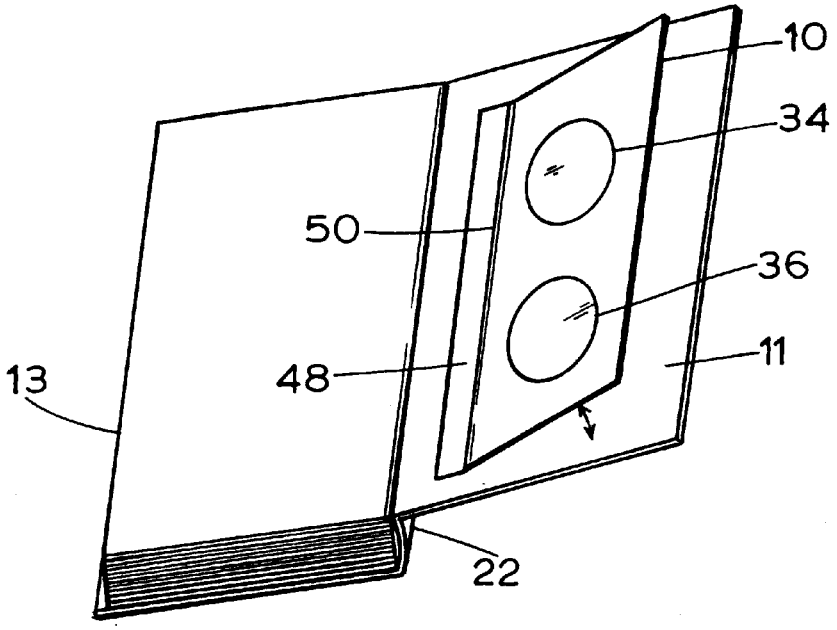
FIG. 6 is a view of the assembled book insert CD carrier device attached to the interior rear cover of a book in a semi-rotated position.

With reference also to FIGS. 3 and 6, the sheet 10 further includes a pivot panel 44 and an attachment panel 46 that cooperate to form a base member 48 by which the carrier device 10 is secured to the book 13 and to form a pivot hinge 50 about which the carrier device 10 may rotate. In particular, starting at the main panel 14 and moving toward the rightmost outer edge of the sheet 10, the carrier device 10 includes the main panel 14, the pivot panel 44, the attachment panel 46 and a set of two cover panels 56 and 58 (see also FIGS. 5, 7 and 8). The pivot panel 44 is divided from the main panel 14 by a hinge line 52 and the attachment panel 46 is divided from the pivot panel 44 by a hinge line 54. In addition, the cover panels 56 and 58 are divided from the attachment panel 46 by a hinge line 62.

Figure 7:
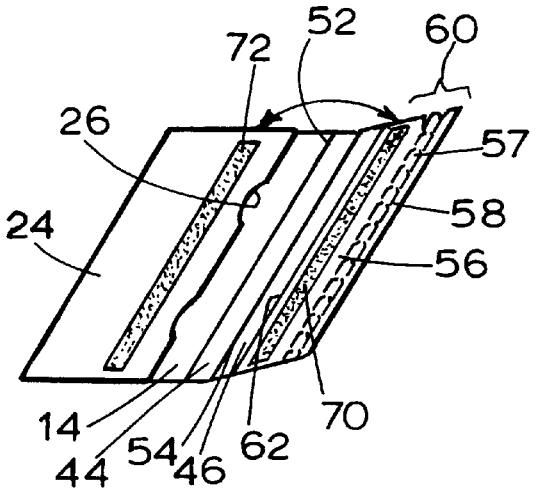
FIG. 7 is a view of the book insert CD carrier device that shows the manner in which a set of cover panels are folded toward the pocket panel to form the cover for the pocket.
Figure 8:
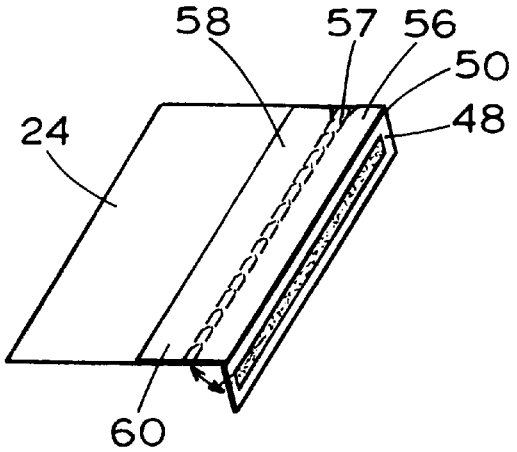
FIG. 8 is a view of the assembled book insert CD carrier device having a sturdy base portion in a semi-rotated position about a pivot hinge and having the pocket sealed with the cover.

Referring also to FIGS. 7 and 8, the attachment panel 46 is folded about the hinge line 54 until the non-glossy surface of the pivot panel 44 is brought into contact with and abuts against the non-glossy surface of the attachment panel 46. Because the pivot panel 44 and attachment panel 46 have equal widths, folding the attachment panel 46 in this manner causes the hinge lines 52 and 62 to align thereby to form the pivot hinge 50 about which the carrier device 10 may move in much the same way as the pages of a book pivot about the spine or backbone of the book (see FIG. 6). To lend flexibility to the pivot hinge 50, the hinge line 62 is preferably perforated or slitted. In addition, the pivot panel 44 and attachment panel 46, when folded together in this manner, form the base 48 for the carrier device 10. The base 48 includes an adhesive strip 64 (see FIG. 2) that is disposed on the glossy side of the attachment panel 46 in a lengthwise manner and that is used to secure the carrier device 10 to the interior of the book cover 11. Thus, the base 48 provides a sturdy means by which to attach the carrier device 10 to the book 13 and the pivot hinge 50 (see FIG. 6) acting in cooperation with the base 48 allows the carrier device 10 to rotate but at the same time prevents the placement of undue stress upon the carrier device 10 which might otherwise cause the carrier device 10 to become detached from the book 13. The configuration of the pivot hinge 50 and the base 48 also permits the carrier device 10 to lie flat between the first or last page of the book 13 and the book cover 11 so that the carrier device 10 does not prevent the book cover 11 from fully or nearly fully closing.

Although in the preferred embodiment, the adhesive strip 64 is disposed on the glossy side of the attachment panel 46, it may instead be located on the glossy side of the pivot panel 44. Thus, the carrier device 10 may be secured to the book cover 11 by either the attachment panel 46 or the pivot panel 44. Preferably, the adhesive strip 64 is a peel and seal strip having a strip of adhesive material on top of which is disposed a removable liner. The carrier device 10 is secured to the book cover 11 by removing the adhesive strip liner to expose the adhesive material thereunder and by pressing the side of the attachment panel 46 on which the adhesive resides against, e.g., the inside surface of the book cover 11. The use of a peel and seal adhesive strip provides for versatility in the manufacturing process by allowing the carrier device 10 to be secured to the book 13 independently of the book manufacturing process.

Referring now to FIG. 7 and 8, the cover panels 56 and 58, together with a tear strip panel 57 that is disposed between the cover panels 56 and 58, form a cover 60 that is used to seal the pocket 26 and that also provides a way by which to access the contents of the pocket 26. The cover panels 56 and 58 are divided from the tear strip panel 57 by a set of perforated seams 66 and 68 (see FIGS. 1 and 2). As described above, the cover panel 56 is disposed adjacent to the attachment panel 46 and is divided from the attachment panel 46 by a hinge line 62. An adhesive strip 70 is disposed in a lengthwise manner on the non-glossy side of the cover panel 56 and an adhesive strip 72 is disposed in a lengthwise manner on the glossy side of the pocket panel 24. To seal the pocket 26, assuming that the base 48 is assembled such that the hinge lines 52 and 62 are aligned and abut against one another, the cover 60 is folded at the hinge line 62 and the cover panel 56 is secured to the non-glossy surface of the main panel 14 by adhesive strip 70. In addition, cover panel 58 is secured to the glossy side of the pocket panel 24 via the adhesive strip 72. Of course, it will be understood that to facilitate the securement of cover panel 58 to the pocket panel 24, the adhesive strip 72 must be disposed at a position on the glossy surface of the pocket panel 24 such that folding the cover 60 about the hinge line 62 causes the cover panel 58 to align with the adhesive strip 72. The adhesive strips 70 and 72 seal the carrier device 10 and also provide stability so that the force required to remove the tear strip panel 57 at seams 66 and 68 may be applied without damaging or tearing the other panels of the carrier device 10. In addition, to facilitate the removal of the tear strip panel 57, a tab 74 (see FIG. 2) by which the tear strip panel 57 may be easily grasped is provided.

It will be understood to those having ordinary skill in the art that although the preferred embodiment uses peal and seal adhesive strips, any other adhesive may alternatively be used. For example, an adhesive that allows for easy removal of the CD carrier device 10 from the book may instead be desired. In addition, the hinge lines described herein may include any type of hinge line, including, for example, scored hinge lines or slitted hinge lines that lend flexibility to the hinge and thereby facilitate folding about the hinge line. Moreover, although the preferred embodiment is sized to hold two standard sized CDs, the carrier device 10 may instead be configured and sized to hold fewer or more CDs and thus may include additional or fewer pockets. Lastly, although shown attached to the interior cover 11 of the book 13, the carrier device 10 may instead be attached to the exterior cover 11 of a book 13, which may be hard cover or soft cover, or any other desired, similarly sized media.

In accordance with the present invention, a unique CD carrier book insert has been provided. By reason of the present invention, the book vendor is provided with a device for packaging a book and one or more CDs as a single unit thereby facilitating the unitary sale of two different information presentation formats in a single product.

While in the foregoing there has been set forth a preferred embodiment of the invention, it will be appreciated that the details herein given may be varied by those skilled in the art without departing from the true spirit and scope of the appended claims.

What is claimed is:

1. A carrier for insertion into a book, the carrier comprising;

a single sheet of paperboard, the sheet comprising a plurality of panels; the panels being divided by a plurality of hinge lines, wherein the panels are folded about the hinge lines to form:

at least one pocket for carrying a disc-shaped object;

a base for securing the carrier to the book;

a pivot hinge between the base and the pocket for rotating the carrier relative to the base; and a cover for the pocket.

2. A carrier according to claim 1 wherein the at least one pocket comprises:

a main panel; and a pocket panel disposed adjacent to the main panel, wherein the main panel and the pocket panel are divided by a hinge line; and wherein the pocket panel is folded about the hinge line and toward the main panel and further wherein the pocket panel is secured to the main panel thereby to form a recess between the main panel and the pocket panel.

3. A carrier according to claim 2 wherein the pocket panel is secured to the main panel by a strip of adhesive and further wherein the strip of adhesive is disposed such that the at least one pocket is divided into a set of compartments.

4. A carrier according to claim 3 wherein at least one of the set of compartments is large enough to hold a compact disc.

5. A carrier according to claim 3 wherein the strip of adhesive comprises a strip of glue.

6. A carrier according to claim 2 wherein the main panel comprises:

a first tab and a second tab, the first and second tabs being disposed on first and second sides of the main panel wherein the first and second sides oppose one another;

and further wherein the pocket panel is secured to the main panel at the first and second tabs.

7. A carrier according to claim 1 wherein the at least one pocket further comprises at least one window.

8. A carrier according to claim 7 wherein the at least one window is covered by a film that is translucent such that an interior portion of the pocket may be viewed.

9. A carrier according to claim 1 further comprising a strip of adhesive for securing the base to the book.

10. A carrier according to claim 9 wherein the strip of adhesive comprises a peal and seal adhesive strip.

11. A carrier according to claim 1 wherein the carrier is secured to a cover of the book.

12. A carrier according to claim 11 wherein the carrier is secured to an interior side of the cover of the book.

13. A carrier according to claim 1 further comprising a main panel and wherein the base comprises:

a pivot panel that is adjacent to the main panel, wherein the main panel and the pivot panel are divided by a first hinge line; and an attachment panel that is disposed adjacent to the pivot panel and that is divided from the pivot panel by a second hinge line, wherein the attachment panel is folded about the second hinge line until the attachment panel abuts against the pivot panel thereby to form the base; and further wherein the attachment panel is adapted to be secured to the book.

14. A carrier according to claim 1 further comprising a main panel and wherein the base comprises:

a pivot panel that is adjacent to the main panel, wherein the main panel and the pivot panel are divided by a first hinge line; and an attachment panel that is disposed adjacent to the pivot panel and that is divided from the pivot panel by a second hinge line, wherein the attachment panel is folded about the second hinge line until the attachment panel abuts against the pivot panel thereby to form the base; and further wherein the pivot panel is adapted to be secured to the book.

15. A carrier according to claim 13 wherein the attachment panel is disposed adjacent to the cover and is divided from the cover by a third hinge line and further wherein forming the base by folding the attachment panel about the second hinge line until the attachment panel abuts against the pivot panel causes the first hinge line and the third hinge line to align thereby to form the pivot hinge.

16. A carrier according to claim 15 wherein the third hinge line is perforated.

17. A carrier according to claim 1 wherein the cover is adapted to be used to enclose an opening in the at least one pocket, the opening being disposed between a first side of the at least one pocket and a second side of the at least one pocket, the cover comprising:

a tear strip;

a first tear strip panel and a second tear strip panel, wherein the first and second tear strip panels are disposed on opposing sides of the tear strip;

a set of perforated seams, wherein the first and second tear strip panels are divided from the tear strip by the set of seams; and wherein the first tear strip panel is secured to the first side of the at least one pocket and further wherein the second tear strip panel is secured to the second side of the at least one pocket.

18. A carrier for insertion into a book, the carrier comprising;

a single sheet of paperboard having an exterior surface and an interior surface and further comprising:

a main panel;

a pocket panel disposed adjacent to the main panel and divided from the main panel by a first hinge line, wherein the pocket panel is folded about the first hinge line and secured to the interior surface of the main panel to form a pocket;

a pivot panel disposed adjacent to the main panel and divided from the main panel by a second hinge line;

an attachment panel disposed adjacent to the pivot panel and divided from the pivot panel by a third hinge line, wherein the attachment panel is folded about the third hinge line until it abuts against the pivot panel to form a base, and further wherein the exterior surface of the base is adapted to be secured to the book; and a cover for the pocket disposed adjacent to the attachment panel and divided from the attachment panel by a fourth hinge line, the fourth hinge line being disposed such that when the base is formed by folding the attachment panel until it abuts against the pivot panel, the second hinge line aligns with the fourth hinge line thereby to form a pivot hinge for rotating the carrier relative to the base.

19. A carrier for insertion into a book, the carrier comprising;

a single sheet of paperboard having an exterior surface and an interior surface and further comprising:

a main panel;

a pocket panel disposed adjacent to the main panel and divided from the main panel by a first hinge line, wherein the pocket panel is folded about the first hinge line and secured to the interior surface of the main panel to form a pocket;

a pivot panel disposed adjacent to the main panel and divided from the main panel by a second hinge line;

an attachment panel disposed adjacent to the pivot panel and divided from the pivot panel by a third hinge line, wherein the attachment panel is folded about the third hinge line until it abuts against the pivot panel to form a base, and further wherein the exterior surface of the base is adapted to be secured to the book;

a cover for the pocket disposed adjacent to the attachment panel and divided from the attachment panel by a fourth hinge line, the fourth hinge line being disposed such that when the base is formed by folding the attachment panel until it abuts against the pivot panel, the second hinge line aligns with the fourth hinge line thereby to form a pivot hinge for rotating the carrier relative to the base;

wherein the cover comprises a tear strip and a set of two tear strip panels, each of the tear strip panels being disposed on opposing sides of the tear strip and being divided from the tear strip by a set of seams, and wherein the set of seams are perforated such that the tear strip may be removed from the sheet by pulling the tear strip thereby to cause the set of seams to separate; and further wherein a first of the tear strip panels is secured to the interior surface of the main panel and a second of the tear strip panels is secured to the exterior surface of the pocket panel.

20. A carrier according to claim 19 further comprising:

a first strip of adhesive for securing the pocket panel to the main panel;

a second strip of adhesive for securing the base to the book;

a third strip of adhesive for securing the first tear strip panel to the interior surface of the main panel; and a fourth strip of adhesive for securing the second tear strip panel to the exterior surface of the pocket panel.

21. A carrier according to claim 20 wherein the second strip of adhesive comprises a peal and seal adhesive strip; and wherein the third strip of adhesive comprises a peal and seal adhesive strip; and further wherein the fourth strip of adhesive comprises a peal and seal adhesive strip.

22. A carrier according to claim 19 wherein the pocket comprises a set of two compartments, wherein each of the compartments are at least large enough to hold a compact disc.

* * * * *